United States Patent [19]

Nakagawa et al.

[11] 3,960,743

[45] June 1, 1976

[54] BLEACHING COMPOSITION

[75] Inventors: Yunosuke Nakagawa, Koshigaya; Koitsu Sato, Funabashi, both of Japan

[73] Assignee: Kao Soap Co., Ltd., Tokyo, Japan

[22] Filed: Apr. 23, 1974

[21] Appl. No.: 463,384

[52] U.S. Cl. ..... 252/99; 252/95; 252/100; 252/186

[51] Int. Cl.[2] ..... C11D 7/54

[58] Field of Search ..... 252/100, 99, 103, 186

[56] References Cited

UNITED STATES PATENTS 2,955,905 11/1960 Davies et al. ..... 252/99 X

*Primary Examiner*—Mayer Weinblatt

*Attorney, Agent, or Firm*—Woodhams, Blanchard and Flynn

[57] ABSTRACT

A bleaching composition comprising an inorganic peroxide capable of releasing hydrogen peroxide in aqueous solution and an activating agent represented by the following general formula

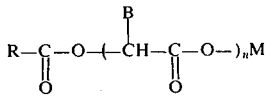

wherein R stands for an alkyl group having 1 to 16 carbon atoms, a halogen- or hydroxyl-substituted alkyl group having 1 to 16 carbon atoms or a substituted aryl group, B designates a hydrogen atom or an alkyl group having 1 to 3 carbon atoms, M represents a hydrogen atom, an alkyl group having 1 to 4 carbon atoms or an alkali metal, and n is an integer of at least 1 when M is an alkyl group or n is an integer of at least 2 when M is a hydrogen atom or an alkali metal.

7 Claims, No Drawings

BLEACHING COMPOSITION

BACKGROUND OF THE INVENTION

1. Field of the Invention

This invention relates to a bleaching composition containing an activating agent. More particularly, the invention relates to an activating agent that can improve the bleaching power of an inorganic peroxide bleaching agent at low temperatures.

2. Description of the Prior Art

Inorganic bleaching agents such as sodium perborate generally exhibit a very high bleaching effect when used at high temperatures above 80°C. However, their bleaching effect at low temperatures, particularly below 40°C, is very poor. Therefore, various research works have heretofore been made to develop activating agents capable of improving the bleaching activity of inorganic peroxides at low temperatures. Known effective activating agents are roughly divided into esters and N-acyl compounds. For example, glucose pentaacetate is known as the former type activating agent and N,N,N′,N′-tetra-acetylethylene diamine is known as the latter type activating agent.

Most of these known activating agents are low-molecular-weight substances. We have made research works with a view to developing high-molecular-weight activating agents having a high dirt-dispersing property and exhibiting a high activation efficiency per molecule.

SUMMARY OF THE INVENTION

We have found that a polyester represented by the following general formula (I)

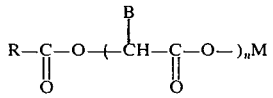

wherein R stands for an alkyl group having 1 to 16 carbon atoms, a halogen- or hydroxyl-substituted alkyl group having 1 to 16 carbon atoms or a substituted aryl group, B designates a hydrogen atom or an alkyl group having 1 to 3 carbon atoms, M represents a hydrogen atom, an alkyl group having 1 to 4 carbon atoms or an alkali metal, and $n$ is an integer of at least 1 when M is an alkyl group or $n$ is an integer of at least 2 when M is a hydrogen atom or an alkali metal, exhibits an excellent activity of promoting and improving the bleaching action to inorganic peroxides even at low temperatures. Based on this finding we have now completed this invention.

Specific examples of the activating agent represented by the above general formula (I) are as follows:

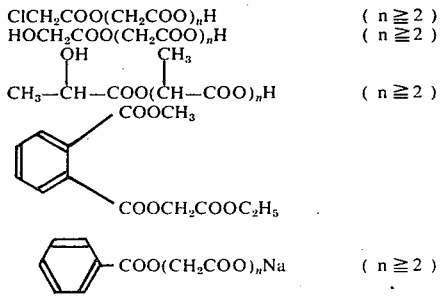

The activating agent of this invention is structurally characterized in that two or more of the ester linkages are present continuously in such a manner that one carbon atom (not inclusive of carbon atoms on the side chain) is interposed between every two adjacent ester linkages. Compounds having only one ester linkage exhibit no activating effect.

In the above general formula (I), $n$ indicates the degree of polymerization, and $n$ can be up to about 100 but it is especially preferred that $n$ is 5 to 30. The preferred degree of polymerization varies to some extent depending on the use. For instance, when the bleaching is conducted for a short time, it is preferred that the degree of polymerization ($n$) is lower, and when the bleaching is conducted for a long time, a higher degree of polymerization ($n$) is preferred. Such condition, however, is not particularly critical in this invention.

The inorganic peroxide to be used in this invention is a compound capable of releasing hydrogen peroxide in an aqueous solution, and, as such inorganic peroxides, there can be mentioned, for example, aqueous hydrogen peroxide, sodium perborate, sodium percarbonate, sodium peroxypyrophosphate, sodium peroxysilicate and sodium peroxytripolyphosphate.

The mixing weight ratio of the polyester as the activating agent and the peroxide as the bleaching agent is within a range of from 1 : 9 to 9 : 1, preferably from 3 : 7 to 7 : 3.

The bleaching composition of the present invention can be prepared in advance or immediately before the use. If necessary, an anionic surface active agent, a non-ionic surface active agent, a neutral or alkaline inorganic builder or other additives can be incorporated therein.

As the anionic surface active agent, there can be mentioned, for example, sodium alkylsulfates having 8 to 20 carbon atoms, sodium salts of higher fatty acids having 10 to 20 carbon atoms, sodium alkylbenzenesulfonates having 10 to 20 carbon atoms in the alkyl group, sodium alkylpolyoxyethylene ether sulfates having 10 to 20 carbon atoms in the alkyl group and an added ethylene oxide mole number of 1 to 40, sodium alkylphenol polyoxyethylene ether sulfates having 8 to 20 carbon atoms in the alkyl group and an added ethylene oxide mole number of 1 to 40, sodium alkanesulfonates having 10 to 20 carbon atoms, and the like. As the non-ionic surface active agent, there can be mentioned, for example, alkylphenol polyoxyethylene ethers having 8 to 20 carbon atoms in the alkyl group and an added ethylene oxide mole number of 1 to 50, alkylpolyoxyethylene ethers having 8 to 20 carbon atoms in the alkyl group and an added ethylene oxide mole number of 1 to 50, and the like.

As the neutral inorganic salt (builder), there can be employed sodium sulfate, sodium chloride and the like, and as the alkaline inorganic salt, there can be employed condensed phosphoric acid salts such as sodium tripolyphosphate and sodium pyrophosphate, and sodium carbonate, sodium bicarbonate, sodium silicate and the like. Furthermore, metal blocking compounds such as sodium ethylene-diamine-tetra-acetate and sodium nitrilotriacetate, fluorescent dyes, perfumes and other additives can optionally be incorporated in the bleaching composition of this invention.

It will be understood that the adjuncts used in the bleaching composition of the invention can be selected from among those conventionally used for this purpose in accordance with conventional practice. Since the present invention does not contain any discovery relating to such adjuncts, further description of them is believed unnecessary.

In the composition of this invention, proportions of the foregoing components are as follows (all percentages are by weight):

Surface Active Agent: 0.1 to 50 percent, preferably 1 to 20 percent
Inorganic Peroxide: 0.1 to 60 percent, preferably 1 to 40 percent
Activating Agent: 0.1 to 50 percent, preferably 0.5 to 30 percent
Inorganic Salt: 20 to 99 percent, preferably 30 to 90 percent
Other Additives: 0.01 to 10 percent, preferably 0.1 to 5 percent It is preferred that an aqueous solution of the bleaching composition of this invention has a pH of 6 to 11, especially 7 to 10. It is also preferred that the concentration of the bleaching composition of this application is such that the effective oxygen concentration is 10 to 2000 ppm, especially 20 to 500 ppm.

The present invention will be further described by reference to the following illustrative Examples.

EXAMPLE 1

50 g of sodium monochloroacetate was placed in a 200 cc-capacity beaker and the beaker was allowed to stand still for 45 minutes in a drier of the electric heater type maintained at 150°C., whereby a slightly brownish solid was obtained. Then, the solid was pulverized and particles passable through a sieve of 60 Tyler mesh were employed [sample (A)]. The sample (A) was sodium polyglycolate represented by the formula $ClCH_2COO(CH_2COO)_nNa$ which had the degree of polymerization ($n$) of about 7. With use of the sample (A) the following bleaching test was conducted.

A composition (a), (b) or (c) indicated in the following table was added to 100 cc of water, and a soiled cloth contaminated by black tea was bleached in the resulting aqueous solution for 30 minutes at 40°C. under agitation. The bleached cloth was water-washed and dried, and the reflectivity at 550 m$\mu$ was measured by an automatic recording color difference meter.

| | Composition (a) | (b) | (c) |
|---|---|---|---|
| sodium lauryl sulfate | 0.1 g | 0.1 g | 0.1 g |
| sodium perborate | 0.5 g | 0.5 g | 0.5 g |
| sample (A) | 0.5 g | — | — |
| sodium monochloroacetate | — | 0.5 g | — |

Results of the bleaching test expressed in terms of the bleaching power, which corresponds to the difference of the reflectivity between the bleached cloth and the untreated soiled cloth, are as follows:

| Treating Liquid | Bleaching Power |
|---|---|
| (a) | 20.5 |
| (b) | 10.8 |
| (c) | 10.2 |

Note: the reflectivity of the unbleached soiled cloth was 40 to 43.

From the foregoing results, it is apparent that sodium polyglycolate has an activating effect to sodium perborate as the bleaching agent.

EXAMPLE 2

The bleaching test was conducted on the following five kinds of the bleaching agent aqueous solutions in the same manner as in Example 1.

| | Composition (d) | (e) | (f) | (g) | (h) |
|---|---|---|---|---|---|
| sodium dodecylbenzenesulfonate | 0.05g | 0.05g | 0.05g | 0.05g | 0.05g |
| sodium percarbonate | 0.5 g | 0.5 g | 0.5 g | 0.5 g | 0.5 g |
| sodium tripolyphosphate | 0.3 g | 0.3 g | 0.3 g | 0.3 g | 0.3 g |
| 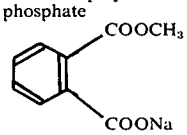 | 0.5 g | — | — | — | — |
| 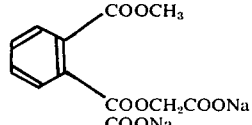 | — | 0.5 g | — | — | — |
| 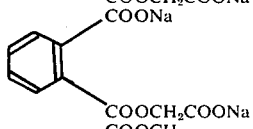 | — | — | 0.5 g | — | — |
| 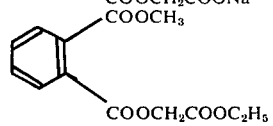 | — | — | — | 0.5 g | — |

Results of the measurement of the bleaching power made on each treating liquid are as follows:

| Treating Liquid | Bleaching Power |
|---|---|
| (d) | 11.8 |
| (e) | 11.0 |
| (f) | 10.8 |
| (g) | 22.3 |
| (h) | 12.0 |

From the foregoing results, it will readily be understood that only the treating liquid (g) containing the activating agent having two ester linkages in the continuous manner had an activating effect to the bleaching agent.

EXAMPLE 3

An activating agent was prepared in the following manner.

30 parts of sodium monochloroacetate was mixed with 70 parts of sodium acetate, and 50 parts of water was added to the mixture to obtain a slurry. Then, the slurry was reacted at a temperature of 120°C. for 1 hour and heat-treated at 150°C. for 1 hour. The resulting reaction product was added to water maintained at 5°C. and the mixture was sufficiently agitated and filtered. The filter cake was sufficiently washed with water to remove unreacted sodium monochloroacetate, sodium acetate, etc., and it was dried at 60°C. under a reduced pressure. The thus obtained reaction product was a mixture of about 65% of $CH_3COO(CH_2COO)_nNa$ and about 35% of $ClCH_2COO(CH_2COO)_nNa$ which had the average degree of polymerization ($n$) of about 7 [sample (B)].

A bleaching liquid was prepared by adding 0.1 g of sodium lauryl sulfate, 0.5 g of sodium perborate and 0.5 g of the sample (B) to 100 cc of water, and with use of this bleaching liquid a black tea-contaminated soiled cloth was bleached at 40°C. for 30 minutes under agitation. The bleaching test was conducted in the same manner as in Example 1. As the result it was found that the bleaching power was 22.2.

EXAMPLE 4

An activating agent was prepared in the following manner.

A mixture of 50% by weight of sodium p-toluene-sulfonate and 50% by weight of sodium monochloroacetate was prepared, and it was allowed to stand still for 2 hours in a drier of the electric heater type maintained at 150°C. to obtain a powdery sodium polyglycolate having an average degree of polymerization of about 19.5.

A bleaching liquid containing 1% by weight of a bleaching composition of the following recipe including the thus prepared sodium polyglycolate was used for bleaching a black tea-contaminated soiled cloth for 30 minutes in the same manner as in Example 1 at a temperature of 20°, 40° or 60°C.

| | Composition (% by weight) (l) | (m) |
|---|---|---|
| sodium perborate | 20 | 20 |
| sodium polyglycolate | 30 | — |
| sodium tripolyphosphate | 49 | 49 |
| sodium sulfate | — | 30 |
| magnesium sulfate | 1 | 1 |

After the above bleaching treatment the bleaching power was measured in the same manner as in Example 1 to obtain the following results:

| Temperature | Treating Liquid (l) | (m) |
|---|---|---|
| 20°C. | 12.0 | 2.0 |
| 40°C. | 18.5 | 7.5 |
| 60°C. | 23.4 | 12.6 |

From the above results, it is apparent that the bleaching composition incorporated with the activiting agent of the present invention had an excellent bleaching effect even at low temperaures.

The embodiments of the invention in which an exclusive property or privelege is claimed are defined as follows:

1. A bleaching composition capable of being dissolved in water, consisting essentially of from 0.1 to 60 percent by weight of an inorganic peroxide capable of releasing hydrogen peroxide in aqueous solution, and from 0.1 to 50 percent by weight of an activating agent having the formula

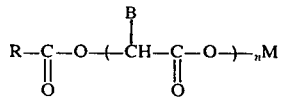

wherein R is $ClCH_2$—, $CH_3$—, $HOCH_2$—,

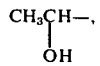

phenyl or methoxycarbonyl-substituted phenyl; B is hydrogen or alkyl having one to 3 carbon atoms; M is hydrogen, alkyl having 1 to 4 carbon atoms, or an alkali metal; and $n$ is an integer from 1 to 100, with the proviso that when M is hydrogen or alkali metal, $n$ is at least 2;

the weight ratio of said activating agent to said inorganic peroxide being in the range of 1:9 to 9:1;

the balance of said composition is water-soluble anionic surfactant, or water-soluble nonionic surfactant, or water-soluble neutral inorganic detergent builder salt, or water-soluble alkaline inorganic detergent builder salt, or mixtures thereof.

2. A bleaching composition according to claim 1, in which said activating agent is selected from the group consisting of

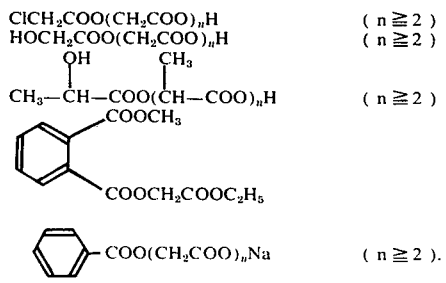

3. A bleaching composition according to claim 1, in which $n$ is 5 to 30.

4. A bleaching composition according to claim 1, in which the inorganic peroxide is selected from the group consisting of aqueous hydrogen peroxide, sodium perborate, sodium percarbonate, sodium peroxypyrophosphate and sodium peroxysilicate.

5. A bleaching composition according to claim 1, in which the weight ratio of said activating agent to said inorganic peroxide is within a range of from 3:7 to 7:3.

6. A bleaching composition as claimed in claim 1 containing from 0.1 to 50 percent by weight of said surfactant and from 20 to 99 percent by weight of said salt.

7. A bleaching composition as claimed in claim 1 in which the amount of said inorganic peroxide is from 1 to 40 percent by weight, the amount of said activating agent is from 0.5 to 30 percent by weight, the amount of said surfactant is from 1 to 20 percent by weight, and the amount of said salt is from 30 to 90 percent by weight, all percentages being based on the total weight of the bleaching composition.

* * * * *